US008332004B2

(12) United States Patent
Stautner et al.

(10) Patent No.: US 8,332,004 B2
(45) Date of Patent: Dec. 11, 2012

(54) SYSTEM AND METHOD FOR MAGNETIZATION OF RARE-EARTH PERMANENT MAGNETS

(75) Inventors: Ernst Wolfgang Stautner, Niskayuna, NY (US); Kiruba Sivasubramaniam Haran, Clifton Park, NY (US); James Rochford, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 28 days.

(21) Appl. No.: 12/977,575

(22) Filed: Dec. 23, 2010

(65) Prior Publication Data

US 2011/0301038 A1 Dec. 8, 2011

(51) Int. Cl.
*H01F 6/06* (2006.01)

(52) U.S. Cl. ..... 505/163; 62/51.1

(58) Field of Classification Search ..... 62/51.1, 62/45.1; 505/100, 163, 166
See application file for complete search history.

(56) References Cited

U.S. PATENT DOCUMENTS

| | | | | |
|---|---|---|---|---|
| 6,489,701 | B1 | 12/2002 | Gamble et al. | |
| 6,995,562 | B2 | 2/2006 | Laskaris et al. | |
| 7,285,881 | B2 | 10/2007 | Steinmeyer et al. | |
| 7,383,688 | B2 | 6/2008 | Van Hasselt | |
| 7,816,826 | B2 | 10/2010 | Gromoll | |
| 2005/0252219 | A1 | 11/2005 | Van Hasselt | |
| 2006/0236709 | A1 | 10/2006 | Steinmeyer | |
| 2007/0001521 | A1 | 1/2007 | Kruip et al. | |
| 2009/0293504 | A1 * | 12/2009 | Oomen et al. | 62/51.1 |

FOREIGN PATENT DOCUMENTS

| | | | |
|---|---|---|---|
| EP | 1670128 | A2 | 6/2006 |

OTHER PUBLICATIONS

EP11194213 Partial Search Report Jun. 25, 2012.

* cited by examiner

*Primary Examiner* — Colleen Dunn
(74) *Attorney, Agent, or Firm* — Ann M. Agosti

(57) ABSTRACT

A system for cooling superconducting materials used for magnetization of magnets disposed within a cylindrical structure, the system including a first tubing system for allowing a cooling gas to interact with a high-field strength superconducting material to thermosiphon-cool the high-field strength superconducting material, a second tubing system for allowing a cooling gas to interact with a low-field strength superconducting material to thermosiphon-cool the low-field strength superconducting material, and a cooling gas in liquefied form configured to flow through the first tubing system and/or the second tubing system. An outlet of the first tubing system and an outlet of the second tubing system are located at a same location on a surface of the cylindrical structure. A method for cool superconducting materials used for magnetization of magnets disposed within a cylindrical structure is also disclosed.

20 Claims, 10 Drawing Sheets

SYSTEM AND METHOD FOR MAGNETIZATION OF RARE-EARTH PERMANENT MAGNETS

BACKGROUND OF THE INVENTION

Exemplary embodiments of the present invention relate generally to the magnetization of permanent magnets and, more specifically, to the magnetization of magnets disposed within rotors or other cylindrical structures using one or more superconducting materials.

Typically, wind turbines are used to convert the kinetic energy in the wind into mechanical power. This mechanical power may be used for specific tasks (such as grinding grain or pumping water) or a generator may convert this mechanical power into electricity. A majority of commercially available wind turbines utilize geared drive trains to connect the turbine blades to the wind generators. The wind turns the turbine blades, which spin a shaft, which feeds into a gear-box and then connects to a wind generator and makes electricity. The wind turbine generators typically operate at a low to medium speed and are permanent-magnet (PM) machines. PM machines have advantages of high efficiency and reliability since there is no need of external excitation and conductor losses are removed from the rotor. PM machines are more compact and simpler and require less maintenance than electromagnetic machines by not requiring electromagnet windings. Modern Rare Earth magnets provide a much denser source of powerful magnetic flux than can windings, and have a high flux and are capable of withstanding reasonably high temperatures. The resulting compact machines find application in structures where size, weight and efficiency are important, such as generators within the nacelles of wind power generators located on the top of high towers, or as motors where space is a premium.

In PM machines, permanent magnets are mounted in the so-called surface mount configuration, on the surface of the rotor, where their poles are oriented radially and axially. Overheating of the permanent magnets is an issue that arises during ramp up, ramp down, and cooldown of the PM machine. Owners, operators, and manufactures of such PM machines would benefit from being able to maintain a uniform temperature of the magnets within the PM machine during all operational modes of the PM Machine.

BRIEF DESCRIPTION OF THE INVENTION

Exemplary embodiment of a system and a method are disclosed herein for cooling superconducting materials used for magnetization of magnets disposed within a cylindrical structure. The system comprises a first tubing system for allowing a cooling gas to interact with a high-field strength superconducting material to thermosiphon-cool the high-field strength superconducting material. The system further comprises a second tubing system for allowing a cooling gas to interact with a low-field strength superconducting material to thermosiphon-cool the low-field strength superconducting material, and a cooling gas in liquefied form configured to flow through the first tubing system and/or the second tubing system. An outlet of the first tubing system and an outlet of the second tubing system are located at a same location on a surface of the cylindrical structure.

In another exemplary embodiment, the system comprises a wicking panel film configured to interact with a superconducting material configured to magnetize the permanent magnet. The system further comprises a cooling liquid configured to interact with the wicking panel film, and a cryocooler in communication with the wicking panel film through which the cooling liquid traverses. The cryocooler is located at a same location on a surface of the cylindrical structure when a plurality of cryocoolers is provided. The cooling liquid is gravitationally fed through the wicking panel film to provide for reuse of the cooling liquid by the cryocooler.

The method comprises providing a first tubing system for allowing a cooling gas to interact with a high-field strength superconducting material to thermosiphon-cool the high-field strength superconducting material, and providing a second tubing system for allowing a cooling gas to interact with a low-field strength superconducting material to thermosiphon-cool the low-field strength superconducting material. The method further comprises locating an outlet of the first tubing system and the second tubing system at a same location on a surface of the cylindrical structure. The method also comprises feeding a cooling gas in liquefied form through the first tubing system and/or the second tubing system to cool the at least the high-field strength superconducting material and/or the low-field strength superconducting material. The method further comprises returning the cooling gas to a location to be fed again through the first tubing system and/or the second tubing system.

Another exemplary embodiment of the method comprises providing a wicking panel film to interact with a superconducting material used for magnetizing a permanent magnet. The method further comprises locating an outlet at a same location on a surface of the cylindrical structure for the wicking panel film and/or a cryocooler, that operates with the wicking panel film and where both the wicking panel film and/or the cryocooler are associated with the superconducting material, as other outlets when a plurality of other superconducting materials are provided. The method also comprises feeding a cooling gas in liquefied form to interact with the superconducting material to cool the superconducting material, and gravitationally feeding the cooling gas through the wicking panel film in liquefied form for reuse of the cooling gas.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not, therefore, to be considered to be limiting of its scope, the embodiments of the invention will be described and explained with additional specificity and detail through the use of the accompanying drawings in which.

DETAILED DESCRIPTION OF THE INVENTION

Figure 1:
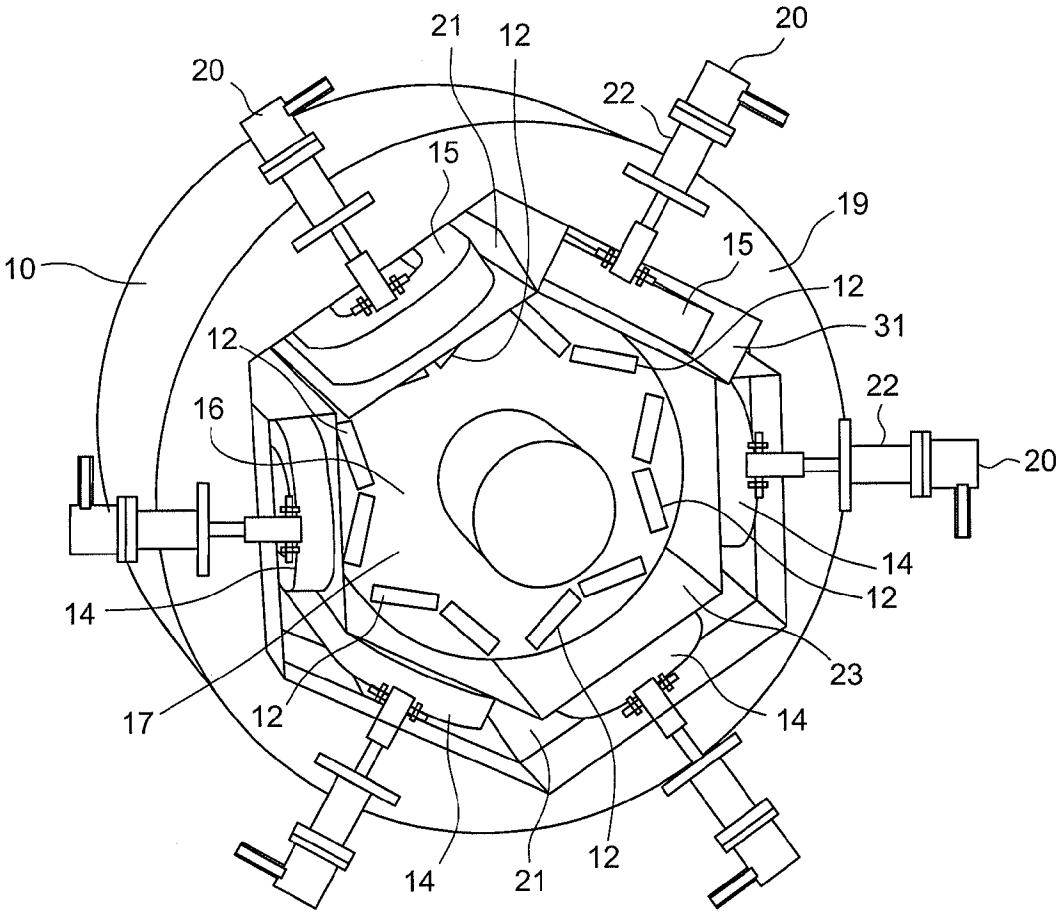
FIG. 1 depicts an exemplary embodiment of a conduction cooled approach for cooling a racetrack coil used to magnetize a permanent magnet.

Reference will be made below in detail to exemplary embodiments of the invention, examples of which are illustrated in the accompanying drawings. Wherever possible, the same reference numerals used throughout the drawings refer to the same or like parts. As disclosed below, multiple versions of a same element may be disclosed. Likewise, with respect to other elements, a singular version is disclosed. Neither multiple versions disclosed nor a singular version disclosed shall be considered limiting. Specifically, although multiple versions are disclosed, a singular version may be utilized. Likewise, where a singular version is disclosed, multiple versions may be utilized.

Though exemplary embodiments of the present invention are described with respect to magnetizing permanent magnet machines, such as permanent magnets used in a wind generator, exemplary embodiments of the invention are also applicable for use with other powered systems, such as, but not limited to, marine vessels, stationary units such as power plants, off-highway vehicles, agricultural vehicles, and/or transportation vehicles, each which may use permanent magnet machines.

Exemplary embodiments of the invention solve problems in the art by providing a method or system for cooling superconducting materials used for magnetization of magnets disposed within rotors or other cylindrical structures. Thus, broadly speaking, a technical effect is to cool superconducting materials used for magnetization of magnets disposed within rotors or other cylindrical structures. To facilitate an understanding of the exemplary embodiments of the invention, it is described hereinafter with reference to specific implementations thereof.

Referring now to the drawings, embodiments of the present invention will be described. Exemplary embodiments of the invention can be implemented in numerous ways, including as a system (including a computer processing system), a method (including a computerized method), an apparatus, a computer readable medium, a computer program product, a graphical user interface, including a web portal, or a data structure tangibly fixed in a computer readable memory. Several embodiments of the invention are discussed below.

FIG. 1 depicts an exemplary embodiment of a conduction cooled approach for cooling superconducting materials used for magnetization of permanent magnets disposed within rotors or other cylindrical structures. As illustrated, an assembly including a rotor 16 having as-formed permanent magnets 12 (e.g., rare-earth magnets such as neodymium magnets) disposed within a bulk 17 (e.g., laminations) of the rotor 16. In one embodiment, the permanent magnets 12 may be NdFeB magnets. The rotor 16 is disposed inside of a superconducting magnetizer assembly 19 having an annular opening 23 configured to receive the rotor 16. As further illustrated, a yoke 10 is provided as part of the magnetizer 19. The yoke 10 may be made from iron, Permedur® (an alloy of approximately fifty percent (50%) cobalt and approximately fifty percent (50%) iron), or similar materials, or any combination thereof.

Within the yoke 10, a plurality, such as four, race track coils 14, 15 are provided spaced around the interior circumference of the yoke. The yoke 10 is generally configured to improve efficiency of the magnetization process by reducing fringe magnetic fields and balancing radial forces produced by the racetrack coils 14, 15. The yoke 10 comprises a plurality of openings 31 configured to house each individual racetrack coil 14, 15. These race track coils 14, 15 interact with the permanent magnets 12, or "poles" imbedded within the rotor 16 to energize the permanent magnets 12. For example, as is explained in more detail below, a higher field strength racetrack coil, or first superconducting material or coil, 15 is energized so as to magnetize the permanent magnets 12 adjacent to at respective racetrack coil 15, followed by a clockwise or counter-clockwise rotation of the rotor 16 so as to bring a non-magnetized permanent magnet 12 pair adjacent to the same respective racetrack coil 15, which allows magnetization of the next set of adjacent permanent magnets 12. This process continues until all permanent magnets 12 in the rotor 16 are magnetized. Once magnetization is complete, the rotor 16 is then moved into an armature (not illustrated) for operation. Though the racetrack coils 14, 15 are disclosed as having a track-like shape, those skilled in the art will readily recognize that these coils may have other shapes as well. Furthermore, these elements 14, 15 may not be coils at all. As disclosed in more detail below, certain features or characteristics are essential for these elements. Thus, the terms "racetrack" and/or "coil" are not used herein to be limiting and simply referring to the racetrack coils disclosed herein as a superconducting material is sufficient. Furthermore, the term "field strength" is not used herein to be limiting. The term is used to refer to a materials', or a coil's, ability to deliver current in a magnetic field.

More specifically, two adjacent racetrack coils produce a high field strength for magnetizing the permanent magnets 12 adjacent to these racetrack coils 15. This may be possible by having a superconductor material, such as, but not limited to, an NbSn compound as part of this first racetrack coil 15. NbSn are considered low temperature compounds. Those skilled in the art will recognize that NbSn is general compound. There are many different NbSn based alloys, for example, $Nb_3Sn$, which is the most common. Another example is $Nb_3Al$. In general, such compounds are identified as A15 type compounds, which include such other compounds as $V_3Ga$, etc. However, NbSn-based coils require features to offset forces resulting from electromagnetic interactions. Accordingly, it may be desirable to incorporate features into the magnetizer assembly 19 described above so as to mitigate such concerns. One such approach is to incorporate other superconducting materials, such as niobium-titanium (NbTi) or an NbTi-based compound, vanadium gallium ($V_3Ga$), and so forth, into the other racetrack coils, or second superconducting material or coil, 14. When compared to the NbSn racetrack coils 15, the NbTi-based racetrack coils 14 produce a lower high field strength. Accordingly, at least two different types of superconducting materials are incorporated into the magnetizing assembly 19.

The NbSn type coil can be replaced by or used with a high-temperature superconducting (HTS) coil or material, e.g., $MgB_2$, or a Bismuth strontium calcium copper oxide-type material (BSCCO) or preferably a Yttrium barium copper oxide-type (YBCO) material or coil. Though both are considered high-field strength superconducting material, the HTS material operates at a higher temperature than NbSn-based compound. As explained below, a cooling gas 26 may be selected based on the type of material used for the high-field strength superconducting material 15, which, as disclosed herein, is configured as a racetrack coil.

A cryocooler 20 is provided to cool the race track coils 14, 15. The cryocooler 20 is also part of the magnetizer assembly 19. The cryocooler 20 may be any cooling media or cooling source, including an external refrigerator that is able to maintain the operating temperature of approximately 4.5 degrees Kelvin at the racetrack coil 14, 15. In an exemplary embodiment, a plurality of cryocoolers 20 are disclosed, each protruding from the yoke 10 of the magnetizer assembly 19. More specifically, each cryocooler 20 comprises a system which includes a tube 22 that extends from the yoke 10 at one end and interacts with a respective racetrack coil 14, 15 at a second end. The cryocooler 20 is connected to or is in thermal communication with a respective racetrack coil 14, 15, such as, but not limited to, a copper plate of the racetrack coil, which operates as a heat sink. The copper plate transfers the heat from one end to the other in the racetrack coil in proximity to the plate, and with the tube, the heat is removed from the heat sink and away from the racetrack coil 14, 15.

Figure 2:
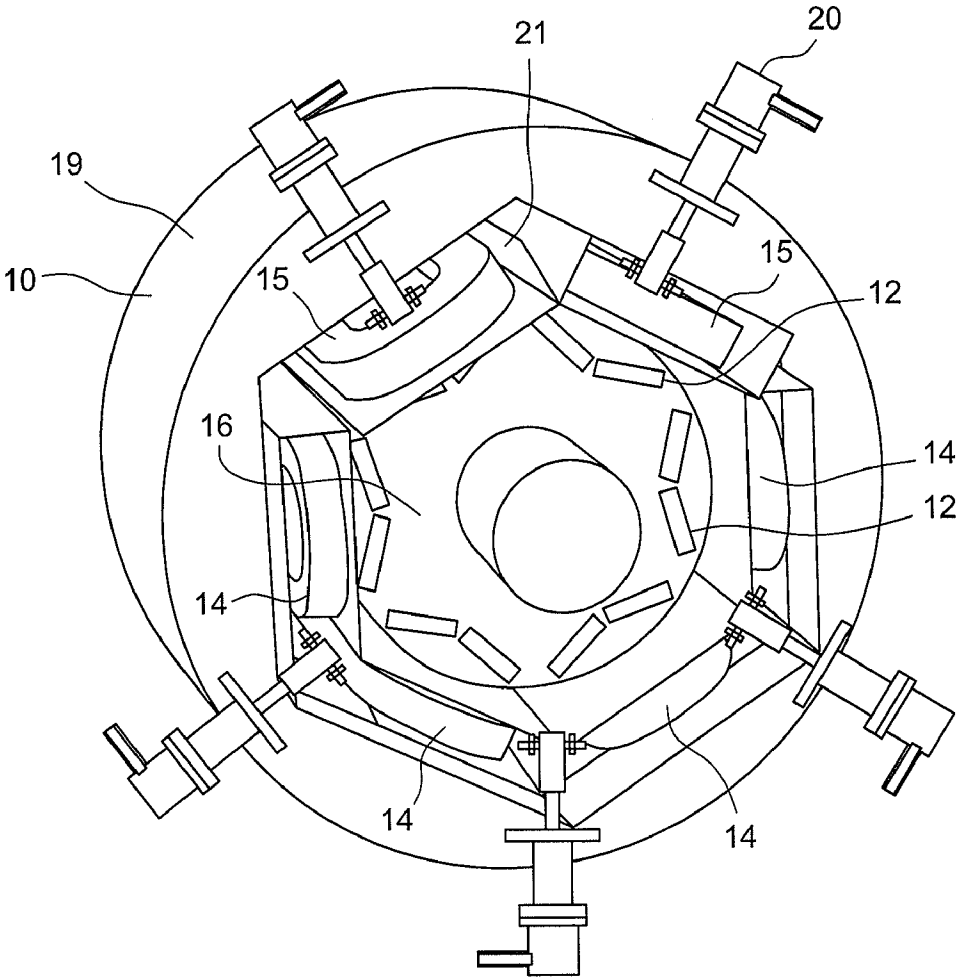
FIG. 2 depicts an exemplary embodiment of a conduction cooled approach for cooling a racetrack coil used to magnetize a permanent magnet with fewer cryocoolers.
Figure 3:
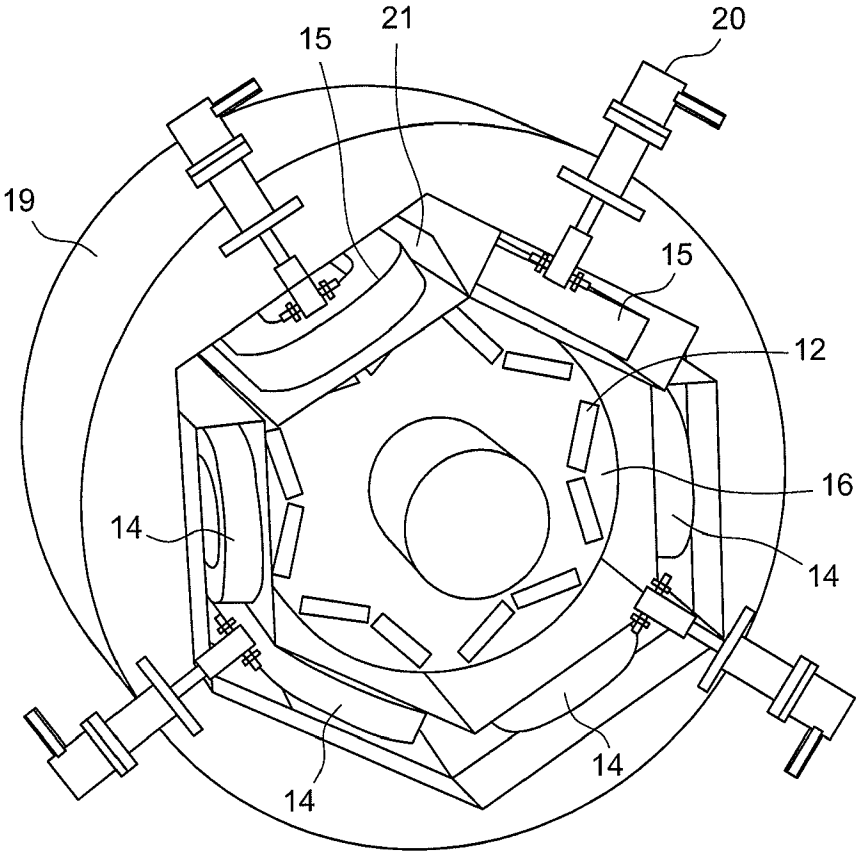
FIG. 3 depicts an exemplary embodiment of a conduction cooled approach for cooling a racetrack coil used to magnetize a permanent magnet with even fewer cryocoolers.

FIG. 2 depicts an exemplary embodiment of a conduction cooled approach for cooling a racetrack coil used to magnetize a permanent magnet with fewer cryocoolers, and FIG. 3 depicts an exemplary embodiment with even fewer cryocoolers. By thermally and mechanically linking adjacent NbTi racetrack coils 14, these racetrack coils 14 can share a same, or one cryocooler 20, thus fewer cryocoolers 20 are required. Since the low-field NbTi racetrack coils 14 do not have the high-field strength of the NbSn racetrack coils 15, reducing the number of cryocoolers 20 to cool more than one set of these superconductors is feasible. As illustrated in FIG. 3, an optimum approach is to only provide two cryocoolers 20 for the NbTi racetrack coils 14, with a single cryocooler being provided for a group of NbTi racetrack coils 14.

Figure 4:
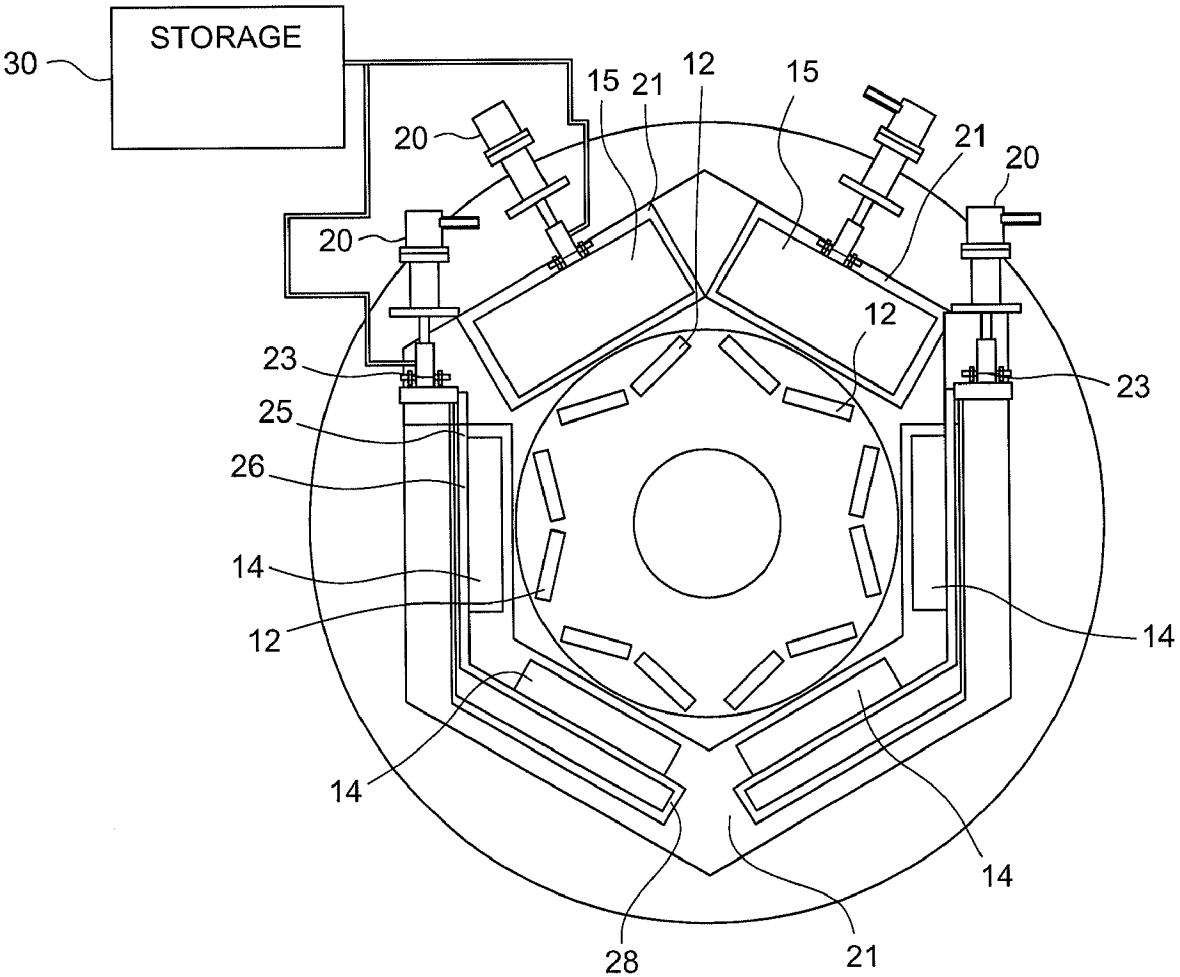
FIG. 4 depicts an exemplary embodiment of a thermosiphon-cooled system for non-superconducting racetrack coil used to magnetize a permanent magnet.

FIG. 4 depicts an exemplary embodiment of a thermosiphon-cooled system for non-superconducting racetrack coil used to magnetize a permanent magnet. Utilizing thermosiphon-cooled racetrack coils 14, 15 results in several advantages. For example, it is inconvenient and expensive to fix cryocoolers 20 about a circumference of the yoke 10 where the cryocoolers 20 are extended from the yoke 10. As disclosed herein, fewer cryocoolers 20 would be required and preferably located at only one central, or same, location on the yoke 10. As evident in FIGS. 4-6 and 8, a central location may be a top location of the yoke or an arc segment of the yoke. Such an approach would best utilize the cryocooler cooling power. Also, direct cooling is realized. Thus, no special heat sinks are required for magnetizing rotors having long lengths. As illustrated, when splitting the figure vertically down a middle of the image, on each side of the yoke 10 are two vertical cryocoolers 20, a first one connected to cool the NbSn racetrack coil 15, or the high-field superconducting coil, and a second one connected to cool the NbTi racetrack coil 14, or the low-field superconducting coil. The second cryocooler 20 is connected to an internal tubing, pipe, or reservoir 25, which is filled with a cooling gas, cooling gas in liquefied form, or cooling liquid, 26. The type of cooling liquid used is determined by the type of material used in racetrack coils 14, 15. For example, with respect to NbSn racetrack coils 15, a type of cooling gas may be, but not limited to, helium gas or a helium-based liquid. When an HTS racetrack coil 15 is used, the cooling gas may include, but is not limited to, helium, hydrogen, neon (all which are likely more appropriate to cool BSCCO and/or $MgB_2$ based coils), and/or nitrogen (which is likely more appropriate to cool YBCO type coils).

The tubing 25 is pressurized so that each cryocooler 20 first liquefies gaseous helium gas fed in from an external storage unit, or reservoir 30. After the racetrack coil 14, 15 cools down, the liquefied helium flows down a vertical line of the tubing which is statically connected or attached to the superconducting racetrack coil so that the helium takes the heat generated away from the racetrack coils 14, 15. Heat is generated within a cryostat of the cryocooler due to thermal radiation onto the racetrack coil 14, 15 and by thermal conduction of the support means holding the racetrack coil 14, 15. The racetrack coil support means may include a cartridge type cryostat, or vacuum chamber, 21 which house the racetrack coil 14, 15, which is placed upon supports to support the weight of the magnet and the magnet forces, as well as current leads to energize the racetrack coils 14, 15 and an attached cryocooler 20, which collectively is used to keep the racetrack coil 14, 15 at a temperature of approximately 4 degrees Kelvin. As further illustrated, a plurality of similar racetrack coils may be housed within a single vacuum chamber 21 as opposed to individual vacuum chambers for each racetrack coil as is illustrated previously, such as in FIG. 3.

During ramping to a full field strength of 10 Tesla, for example, in one (1) minute, heat is generated with the racetrack coil structure. More specifically, during ramping of the racetrack coil, the magnetic field is changed until the maximum field strength is reached. This results in a generation of heat within the racetrack coil. This heat needs to be transferred to the cryocooler 20. The ramp speed is thus limited by the cryocooler cooling capacity.

Thermosiphon cooling is a means of efficiently transporting that heat away from the coil (heat dissipation) to liquefaction fins 23 of the cryocooler 20. With respect to the low field strength superconductor material, or racetrack coil, 14, a A flow loop 28 is provided in the tubing 25 after passing the last racetrack coil 14 so that the heated helium, which may now be in a gaseous state, returns to the cryocooler 20. The helium may be circulated to a storage reservoir 30 for holding other helium which is continuously cycled and recycled through the cryocooler 20 and its respective tubing 25, if required.

Figure 5:
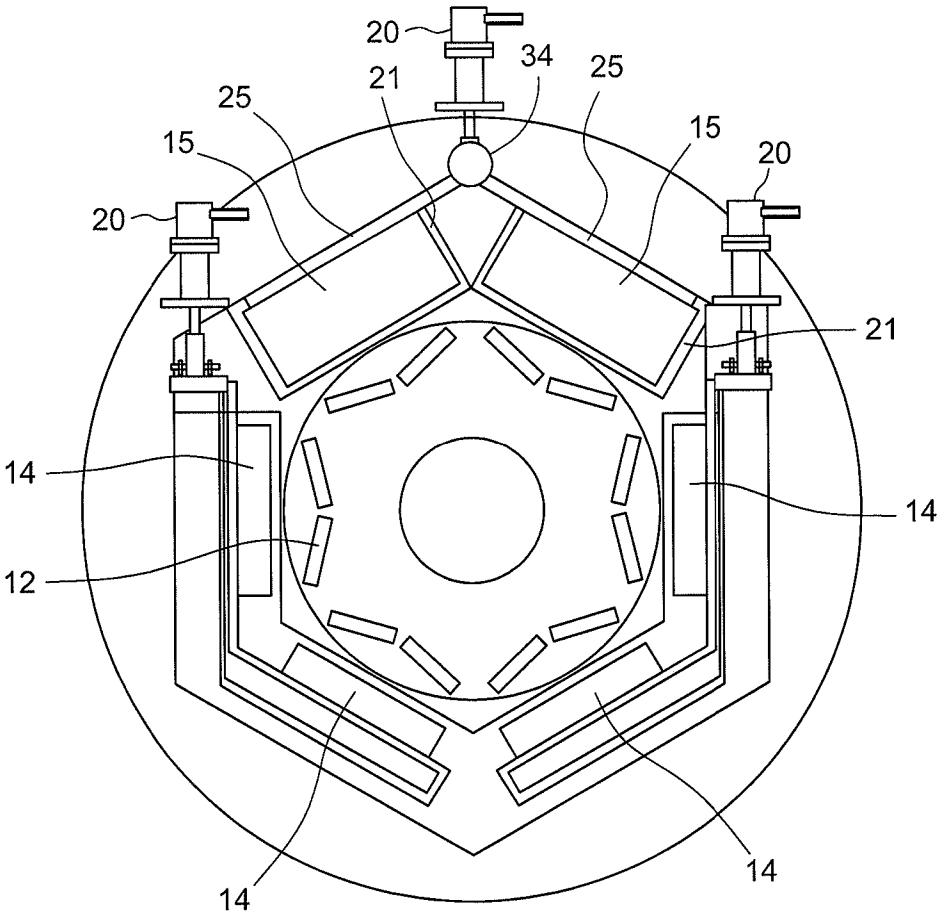
FIG. 5 depicts a supportive thermosiphon-cooled system for the superconducting racetrack coil used to magnetize a permanent magnet.

FIG. 5 depicts a supportive thermosiphon-cooled system for the superconducting racetrack coil used to magnetize a permanent magnet. Even though the high-field superconducting racetrack coils, or first superconducting material, 15 produce the highest electromagnetic fields, they can also be efficiently cooled with a similar heat pipe technique as disclosed in FIG. 4 and, thus, increase the operating margin of its superconductor properties. As illustrated, a single cryocooler 20 is provided to cool all locations of the first superconducting material 15, thus further reducing a number of cryocoolers 20 required, and tubing 25 extends across to each respective racetrack coil 15. The tubing 25 crosses each aperture of each racetrack coil 15. An exemplary description of the tubing is provided below with respect to FIG. 7. As discussed above, the gas may return to a storage unit 34, or reservoir, before, or prior to, being supplied to the cryocooler 20 again for reuse.

Figure 6:
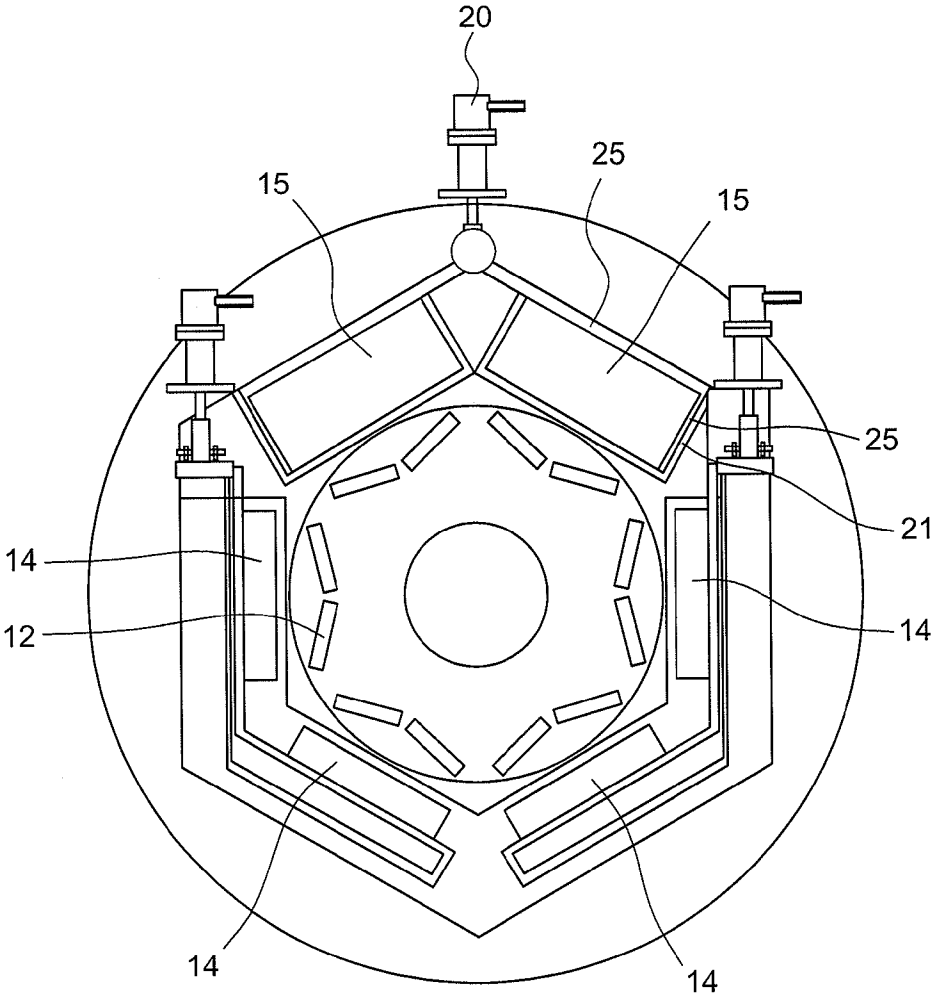
FIG. 6 depicts a supportive thermosiphon-cooled system for the superconducting racetrack coil further comprising cooling sides of the racetrack coils.

FIG. 6 depicts a supportive thermosiphon-cooled system for the superconducting racetrack coil further comprising cooling sides of the racetrack coils. The heat pipe 25 design of FIG. 5 is extended to also cool the side surfaces of the racetrack coils 15, to result in further, improved, homogenous cooling of the high-field, or first, superconducting racetrack coils 15. The heat pipes act as highly efficient heat spreaders and help to ensure (or maintain) uniformity of the cooling of the racetrack coils 15 during ramping and steady-state operation.

Figure 7:
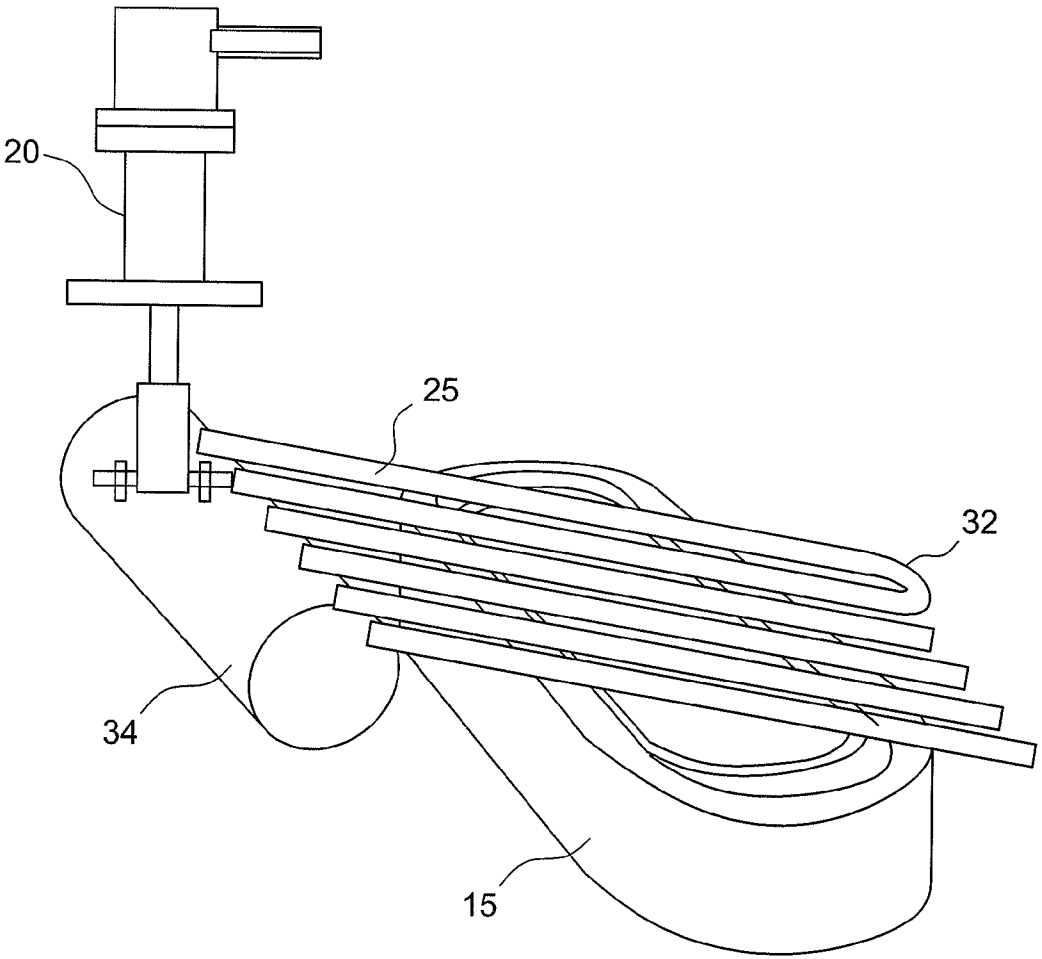
FIG. 7 depicts an exemplary embodiment of the tubing as it may be configured to cool a racetrack coil.

FIG. 7 depicts an exemplary embodiment of the tubing as it may be configured to cool a racetrack coil. Though a plurality of bends 32 with each respective bend connecting adjacent tubing 25 is not shown, the intent of this figure is to illustrate that all tubing 25 disclosed herein does not simply pass over the racetrack coils 14, 15 one time. Instead, there is a plurality of tubes 25 that passes over the aperture of each racetrack coil 14, 15. Each coil 14, 15 may be continuously connected to the other tubes at a location away from the cryocooler 20, such as with a plurality of bends 32. In another embodiment, each tube 25 may have its own individual return line where all return tubes are connected at a common connector, or reservoir, 34 that is located in close proximity to the cryocooler 20. When the tubing is a single tube, liquid from the reservoir 34 may run downward, and pick up the heat from the magnet. Vapor forms and this vapor travels within the tube upwards to the reservoir where it hits the liquefaction fins of the cryocooler. Thus, liquid and gas run in the same tube (gas bubbles and liquid) and at the same time. The tubes can be linked together at the end 32 where the tubes are still filled with liquid and gas bubbles. In another exemplary embodiment, states of the gas reside in different tubes. Thus, one tube is always filled with liquid and the return tube would only carry helium gas then. In this case, the return gas tube must not be in contact with the superconducting coil since the temperature of the gas would be too high, likely higher than 4.2 degrees Kelvin.

Figure 8:
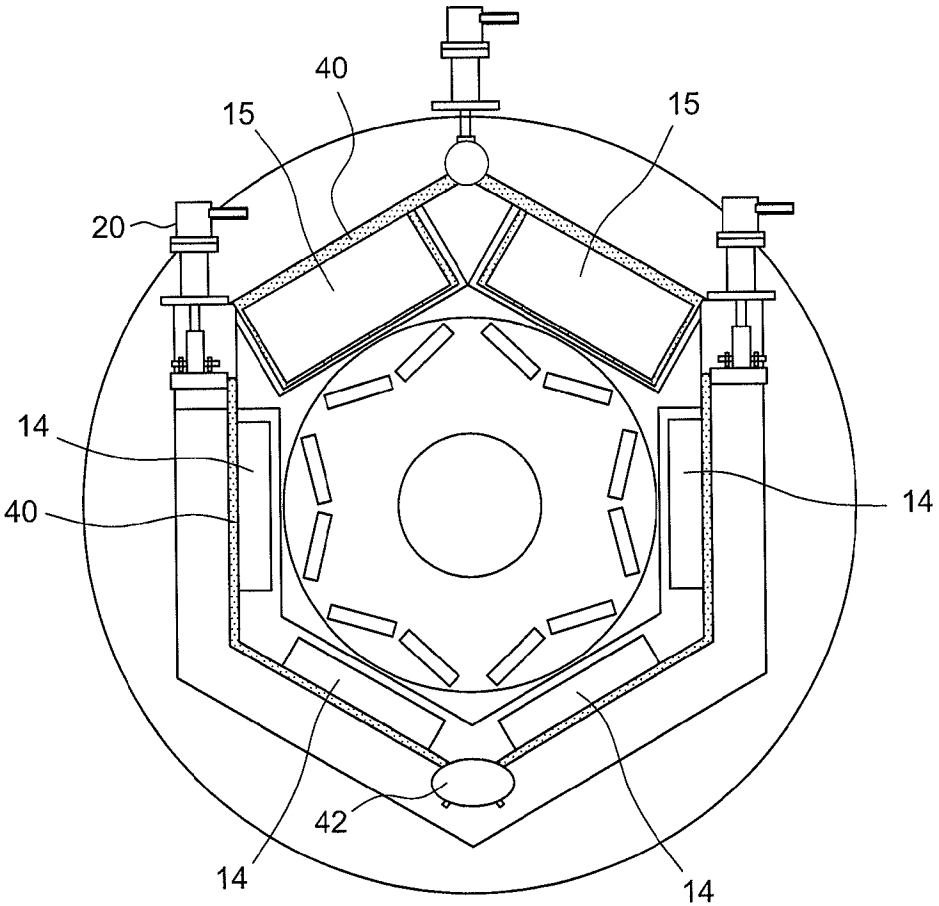
FIG. 8 depicts an exemplary embodiment of a conduction-cooled system using appropriate wicking material.

FIG. 8 depicts an exemplary embodiment of a conduction-cooled system using an appropriate wicking material for a cryogen, such as, but not limited to, helium. As illustrated, the wicking material 40, such as wicking panel film, replaces the tubing disclosed in FIGS. 4-6. More specifically, a securing assembly or apparatus may be provided to hold the wicking panel film in place. In one exemplary embodiment, the securing apparatus may actually be a form of tubing, but the functionality of the tubing disclosed above with respect to FIGS. 4-6 changes when a wicking panel film 40 is utilized. The wicking material may be made of a nanomaterial. The wicking panel film 40 is made out of a wicking material that is actually fitted around the racetrack coils 14, 15. In operation, a cooling liquid 26, such as, but not limited to, liquefied helium, runs, or flows, down the liquefaction fins 23 on the cryocooler 20 until the helium encounters, or interacts with, the wicking surface. The wicking panel film 40 is provided to return the helium to a starting position via a wicking force or process.

In another exemplary embodiment, the helium flows down in a separate channel with no wicking structure and is collected in a bottom tube 42. The wicking panel film 40 is in communication with the bottom tube 42 and through the wicking process, returns the helium to the cryocooler 20 for reuse. To further illustrate the wicking process, if a part or an end of a felt material is submerged within a container holding ink, the ink will travel against gravity up the felt material. The self-contained wicking panel film 40 is within a conduction cooled system that includes a vacuum chamber and a thermal shield that minimizes the amount of radiation experienced by the wicking panel 40 film when not passing by a racetrack coil 14, 15.

Figure 9:
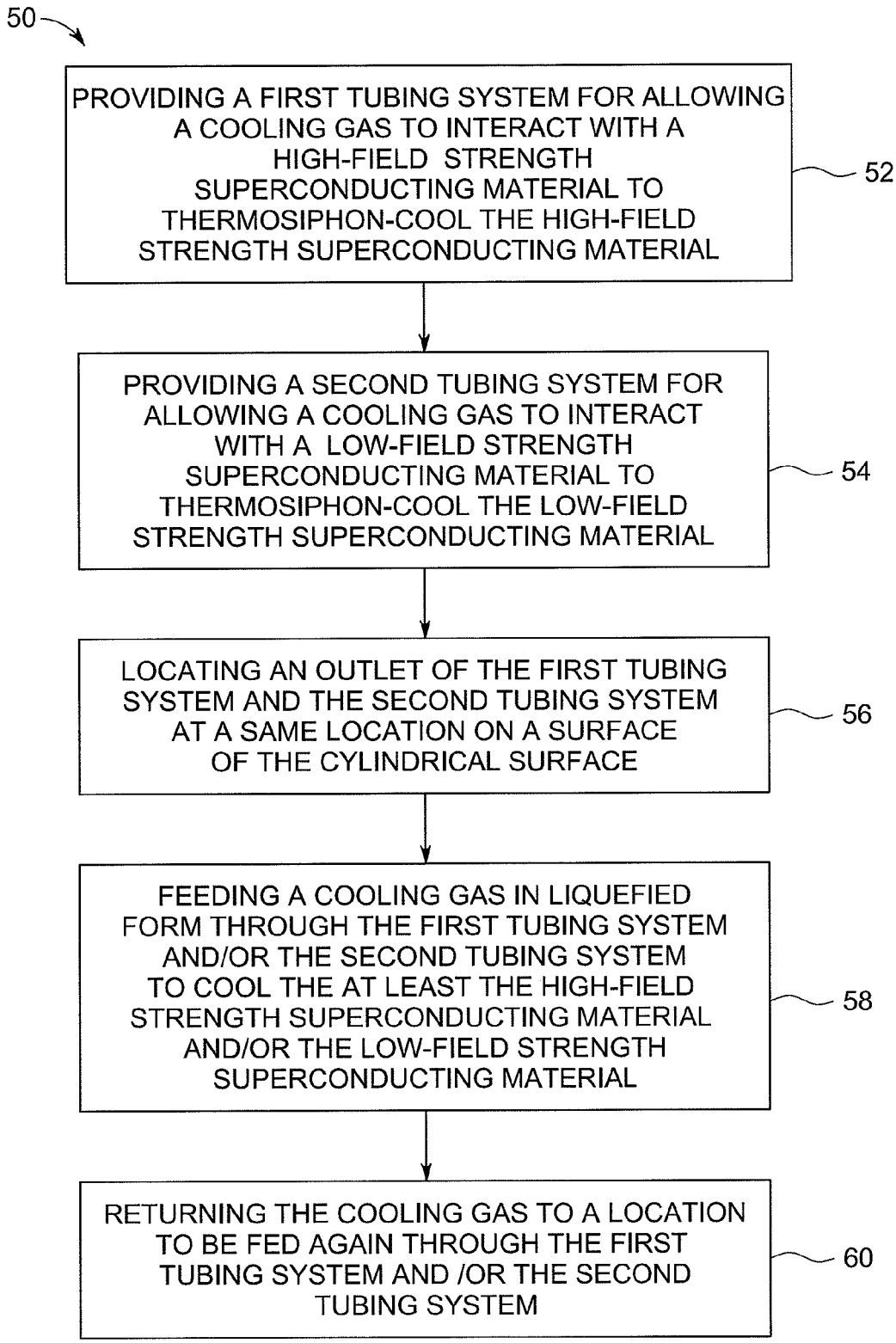
FIG. 9 depicts a block diagram illustrating an exemplary embodiment of a method for cooling a superconducting racetrack coil, or superconducting material, used to magnetize a permanent magnet.

FIG. 9 depicts a block diagram illustrating an exemplary embodiment of a method for cooling superconducting racetrack coils, or a superconducting material, used to magnetize a permanent magnet within a cylindrical structure. As illustrated, the method 50 providing a first tubing system for allowing a cooling gas to interact with a high-field strength, or first, superconducting material to thermosiphon-cool the high-field strength, or first, superconducting material, at 52, and providing a second tubing system for allowing a cooling gas to interact with at least one low-field strength, or second, superconducting racetrack material to thermosiphon-cool the low-field strength or second, superconducting material, at 54. The method further comprises locating an outlet of the first tubing system and the second tubing system at a same, or central, location on a surface of the cylindrical surface, at 56, and feeding a cooling gas in liquefied form through the first tubing system and/or the second tubing system to cool the high-field strength, or first, superconducting material and/or the low-field strength or second, superconducting material, at 58. The gas is returned to a location to be fed again through the first tubing system and/or the second tubing system, at 60.

Figure 10:
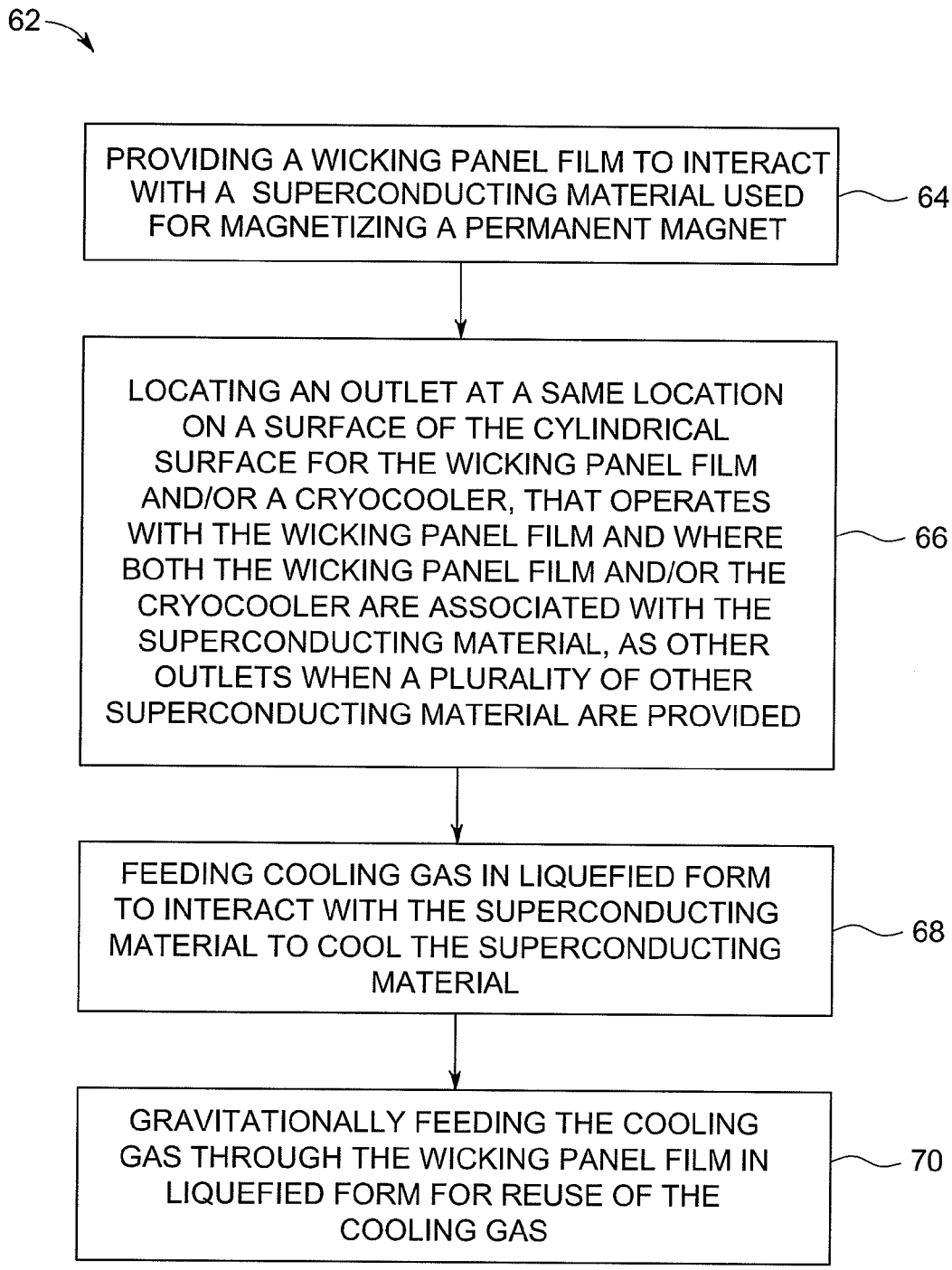
FIG. 10 depicts another block diagram illustrating an exemplary embodiment of a method for cooling a superconducting racetrack coil, or superconducting material, used to magnetize a permanent magnet.

FIG. 10 depicts another block diagram illustrating an exemplary embodiment of a method for cooling superconducting racetrack coils used to magnetize a permanent magnet located within a cylindrical structure. As illustrated, the method 62 comprises providing a wicking panel film to interact with a superconducting material (high-field strength and/or low-field strength) used for magnetizing a permanent magnet, at 64. The method further comprises locating an outlet at a same, or central, location on a surface of the cylindrical surface for the wicking panel film and/or a cryocooler, that operates with the wicking panel film and where both the wicking panel film and/or the cryocooler are associated with the superconducting material, as other outlets when a plurality of other superconducting materials are provided, at 66. The method further comprises feeding a cooling gas in liquefied form to interact with the superconducting material to cool the superconducting material, at 68, and gravitationally feeding the cooling gas through the wicking panel film in liquefied form for reuse of the cooling gas, at 70.

While the invention has been described with reference to various exemplary embodiments, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc., does not denote any order or importance, but rather the terms first, second, etc., are used to distinguish one element from another.

What is claimed is:

1. A system for cooling a superconducting material used for magnetization of magnets disposed within a cylindrical structure, the system comprising:

a first tubing system for allowing a cooling gas to interact with a first superconducting material to thermosiphon-cool the first superconducting material;

a second tubing system for allowing a cooling gas to interact with a second superconducting material to thermosiphon-cool the second superconducting material; and a cooling gas in liquefied form configured to flow through the first tubing system and/or the second tubing system;

wherein an outlet of the first tubing system and an outlet of the second tubing system are located at a central location on a surface of the cylindrical structure, and wherein the field strength of the first superconducting material is different from the field strength of the second superconducting material.

2. The system according to claim 1, further comprising a storage reservoir configured for holding the cooling gas prior to and after flowing through the first tubing system and/or the second tubing system.

3. The system according to claim 1, wherein the first superconducting material comprises an NbSn compound and/or an HTS compound.

4. The system according to claim 1, wherein the second superconducting material comprises an NbTi compound.

5. The system according to claim 1, further comprising a first cryocooler wherein the first tubing system is a part of the first cryocooler.

6. The system according to claim 1, further comprising a second cryocooler wherein the second tubing system is a part of the second cryocooler.

7. The system according to claim 5, wherein the first cryocooler further comprises liquefaction fins.

8. The system according to claim 6, wherein the second cryocooler further comprises liquefaction fins.

9. The system according to claim 1, wherein the cooling gas is based on a type material used in the first superconducting material and/or the second superconducting material.

10. The system according to claim 1, the first superconducting material and/or the second superconducting material comprises a racetrack coil configuration.

11. The system according to claim 1, wherein the cylindrical structure is part of a generator used in a wind turbine application.

12. A system for cooling a superconducting material used for magnetization of a permanent magnet disposed within a cylindrical structure, the system comprising:

a wicking panel film configured to interact with a superconducting material configured to magnetize the permanent magnet;

a cooling liquid configured to interact with the wicking panel film; and a cryocooler in communication with the wicking panel film through which the cooling liquid traverses;

wherein the cryocooler is located at a central location on a surface of the cylindrical structure when a plurality of cryocoolers is provided; and wherein the cooling liquid is gravitationally fed through the wicking panel film to provide for reuse of the cooling liquid by the cryocooler.

13. The system according to claim 12, wherein the wicking panel film is comprised of a nanomaterial.

14. The system according to claim 12, wherein the cooling liquid passes through the cryocooler before interacting with the wicking panel film.

15. The system according to claim 12, wherein the superconducting material comprises an NbSn compound, an NbTi compound, and/or an HTS compound.

16. The system according to claim 12, wherein the cooling liquid is based on a type of superconducting material to be cooled.

17. The system according to claim 12, further comprising liquefaction fins in communication with the cryocooler, wherein the cooling liquid traverses down the liquefaction fins to the wicking panel film.

18. The system according to claim 12, further comprising a tubing in communication with the superconducting material configured for the cooling liquid to pass through before interacting with the wicking panel film.

19. The system according to claim 12, wherein the cylindrical structure is part of a generator used in a wind turbine application.

20. A method for cooling a superconducting material used for magnetization of a permanent magnet disposed within a cylindrical structure, the method comprising:

providing a first tubing system for allowing a cooling gas to interact with a first superconducting material to thermosiphon-cool the first superconducting material;

providing a second tubing system for allowing a cooling gas to interact with a second superconducting material to thermosiphon-cool the second superconducting material, the field strength of the second superconducting material being different than the field strength of the first super conducting material;

locating an outlet of the first tubing system and the second tubing system at a central location on a surface of the cylindrical structure;

feeding a cooling gas in liquefied form through the first tubing system and/or the second tubing system to cool the first superconducting material and/or the second superconducting material; and returning the cooling gas to a location to be fed again through the first tubing system and/or the second tubing system.

* * * * *